US008228241B2

(12) United States Patent
Chiang

(10) Patent No.: US 8,228,241 B2
(45) Date of Patent: Jul. 24, 2012

(54) INVERSE F ANTENNA

(75) Inventor: Meng-Chien Chiang, Taipei County (TW)

(73) Assignee: Sercomm Corporation, Nankang, Taipei (TW)

( * ) Notice: Subject to any disclaimer, the term of this patent is extended or adjusted under 35 U.S.C. 154(b) by 461 days.

(21) Appl. No.: 12/366,714

(22) Filed: Feb. 6, 2009

(65) Prior Publication Data

US 2009/0267864 A1 Oct. 29, 2009

(30) Foreign Application Priority Data

Apr. 24, 2008 (CN) ..... 2008 2 0112012 U

(51) Int. Cl.
*H01Q 1/24* (2006.01)
*H01Q 1/48* (2006.01)
*H01Q 1/36* (2006.01)

(52) U.S. Cl. ..... 343/702; 343/846; 343/899

(58) Field of Classification Search ..... 343/702, 343/846, 899, 700 MS
See application file for complete search history.

(56) References Cited

U.S. PATENT DOCUMENTS

| | | | | |
|---|---|---|---|---|
| 6,724,348 | B2 * | 4/2004 | Fang | 343/702 |
| 2003/0025637 | A1 * | 2/2003 | Mendolia et al. | 343/702 |
| 2005/0001766 | A1 * | 1/2005 | Tasi | 343/700 MS |
| 2006/0038721 | A1 * | 2/2006 | Ozkar et al. | 343/700 MS |
| 2009/0243936 | A1 * | 10/2009 | Huang | 343/700 MS |

* cited by examiner

*Primary Examiner* — Jacob Y Choi
*Assistant Examiner* — Hasan Islam
(74) *Attorney, Agent, or Firm* — Thomas|Kayden

(57) ABSTRACT

An inverse F antenna (IFA) antenna is provided. The IFA antenna includes a ground portion, a radiation portion, a short-circuit portion and a feed-in portion. The width of the radiation portion is larger than the width of the ground portion, such that the operating band of the IFA antenna covers at least a first band and a second band at the same time. The short-circuit portion is disposed on the ground portion and is connected to the radiation portion. The feed-in portion is connected to the radiation portion.

10 Claims, 5 Drawing Sheets

INVERSE F ANTENNA

This application claims the benefit of People's Republic of China application Serial No. 200820112012.3, filed Apr. 24, 2008, the subject matter of which is incorporated herein by reference.

BACKGROUND OF THE INVENTION

1.Field of the Invention

The invention relates in general to an inverse F antenna (IFA), and more particularly to an IFA antenna capable of supporting multiple bands at the same time.

2. Description of the Related Art

Z-wave is a new generation transmission technology for wireless network. The Z-wave transmission technology allows every appliance in a household to stand along and communicate with other devices in the same network via wireless signal, hence dispensing the use of a central controller. Many home appliances can be automatically controlled according to the transmission technology. For example, when a user sends a setting to a home appliance from outdoors, a wireless signal is sent to the sensor of the appliance and the appliance will execute the instruction and function accordingly.

Compared with other wireless network such as WiFi and Bluetooth, the Z-wave transmission technology has lower power consumption because the Z-wave transmission technology only transmits a small volume of data around the house and the transmitter thereof is always in a near standby state, hence increasing the duration of battery and providing more convenience.

The main bands of the current Z-wave protocol include the CE band and the FCC band. The CE band is 868.42 MHz, and the FCC band is 908.42 MHz. To operate under a band of 868.42 MHz, an antenna conforming to the CE protocol is used; to operate under a band of 908.42 MHz, an antenna conforming to the FCC protocol is used.

However, the current antenna used in the Z-wave still cannot support both the CE and FCC bands at the same time. Thus, how to provide an antenna used in Z-wave and capable of supporting both the CE and FCC bands at the same time has become an imminent issue to be resolved in the field of wireless communication.

SUMMARY OF THE INVENTION

The invention is directed to an inverse F antenna (IFA). The width of the radiation portion is designed to be larger than the width of the ground portion, such that the operating band of the IFA antenna covers multiple bands at the same time.

According to a first aspect of the present invention, an inverse F antenna (IFA) antenna is provided. The IFA antenna includes a ground portion, a radiation portion, a short-circuit portion and a feed-in portion. The width of the radiation portion is larger than the width of the ground portion, such that the operating band of the IFA antenna covers at least a first band and a second band at the same time. The short-circuit portion is disposed on the ground portion and is connected to the radiation portion. The feed-in portion is connected to the radiation portion.

The invention will become apparent from the following detailed description of the preferred but non-limiting embodiments. The following description is made with reference to the accompanying drawings.

DETAILED DESCRIPTION OF THE INVENTION

The conventional Z-wave antenna cannot support the CE and the FCC band at the same time. To resolve the above problem, the invention provides an inverse F antenna (IFA) capable of covering multiple bands at the same time covers. The IFA antenna includes a ground portion, a radiation portion, a short-circuit portion and a feed-in portion. The width of the radiation portion is larger than the width of the ground portion, such that the operating band of the IFA antenna covers multiple bands at the same time. The short-circuit portion is disposed on the ground portion and is connected to the radiation portion. The feed-in portion is connected to the radiation portion to transmit a signal. To further elaborate the spirit and application of the invention, a preferred embodiment is disclosed below.

Figure 1:
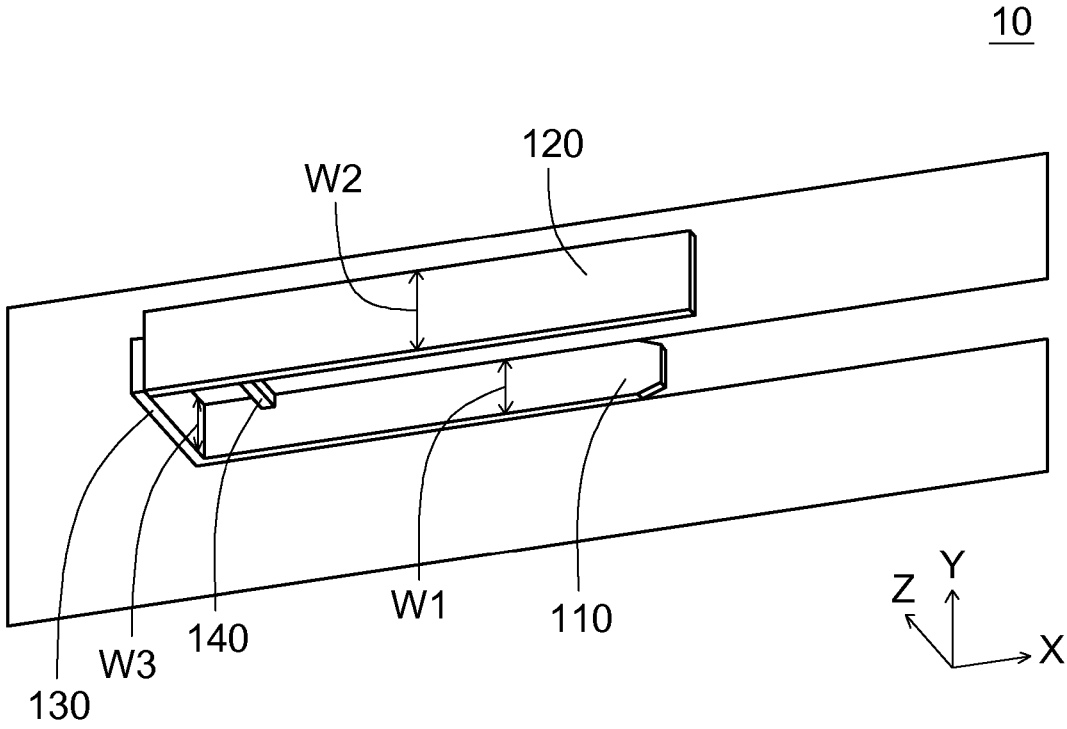
FIG. 1 shows a 3-D perspective of an IFA antenna according to a preferred embodiment of the invention.
Figure 2:
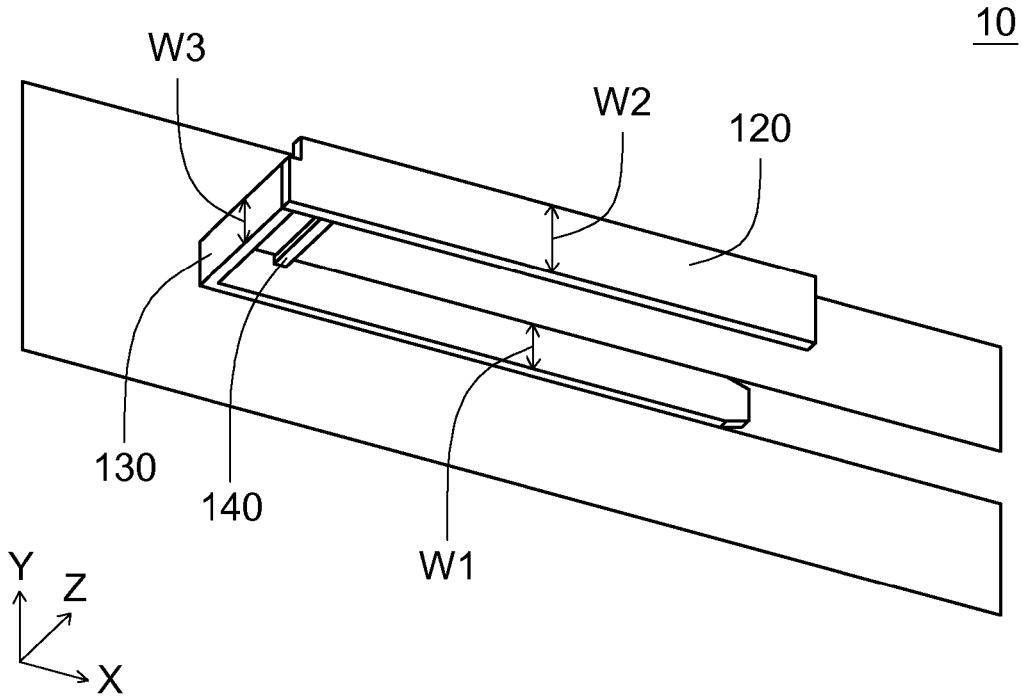
FIG. 2 shows a 3-D perspective of an IFA antenna according to a preferred embodiment of the invention.

Referring to both FIGS. 1 and 2, two 3-D perspectives of an IFA antenna according to a preferred embodiment of the invention are shown. The IFA antenna 10 is used in Z-wave communication and conforms to Z-wave protocol. The IFA antenna 10 includes a ground portion 110, a radiation portion 120, a short-circuit portion 130, and a feed-in portion 140. The widths of the ground portion 110, the radiation portion 120, and the short-circuit portion 130 are respectively designated as the width W1, the width W2 and the width W3. The radiation portion 120 and the short-circuit portion 130 are rectangular metallic pieces and the ground portion 110 is beveled metallic piece for example.

The radiation portion 120 is used for receiving/transmitting a wireless signal, wherein one end of the radiation portion 120 is connected to one end of the short-circuit portion 130. The short-circuit portion 130 is vertically disposed on the ground portion 110, and the other end of the short-circuit portion 130 is connected to one end of the ground portion 110. The radiation portion 120 is electrically connected to the ground portion 110 via the short-circuit portion 130, and the plane of the radiation portion 120 is substantially parallel to the plane of the ground portion 110, wherein the other end of the ground portion 110 is beveled structure for broadening bandwidth and enhance radiation efficiency.

The widths of the ground portion 110, the radiation portion 120 and the short-circuit portion 130 are designed as the width W2>the width W1=the width W3 for example. In a conventional IFA antenna, the width of the radiation portion is smaller than the width of the ground portion. To resolve the problem that the conventional Z-wave antenna cannot support the CE band and the FCC band at the same time, the width W2 of the radiation portion 120 is preferably designed to be larger than the width W1 of the ground portion 110 in the preferred embodiment of the invention. As the width W2 of the radiation portion 120 is larger than the width W1 of the ground portion 110, the operating band of the IFA antenna 10 covers the operating band for the CE and the FCC protocol at the same time. That is, the IFA antenna 10 preferably covers 868.42 MHz band and 908.42 MHz band at the same time, and the ratio of the width W2 vs. the width W1 preferably ranges from 1.15 to 2.

Figure 3:
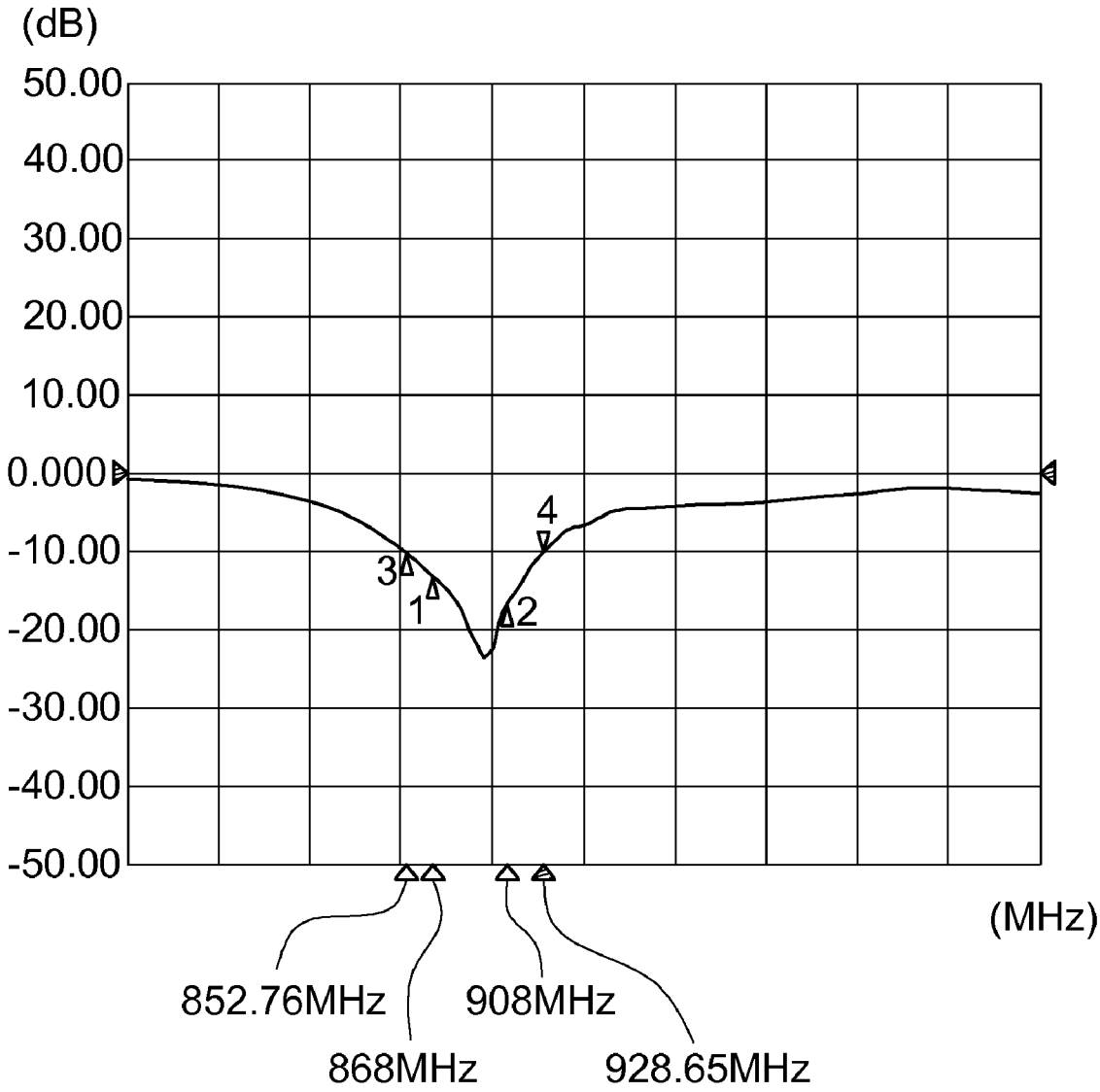
FIG. 3 shows a return loss curve of the IFA antenna 10.

Referring to FIG. 3, a return loss curve of the IFA antenna 10 is shown. In FIG. 3, the return losses of the IFA antenna 10 under frequency 868 MHz, 908 MHz, 852.76 MHz and 928.65 Mz are respectively designated as 1, 2, 3 and 4, and the return losses of the IFA antenna 10 under frequency 868MHz, 908 MHz, 852.76 MHz and 928.65 Mz respectively correspond to −13.366 dB, −16.929 dB, −10.197 dB and −10.201 dB.

As indicated in FIG. 3, when the return loss of the IFA antenna 10 substantially is equal to −10 dB, the operating band of the IFA antenna 10 covers 852.76 MHz and 928.65 Mz band at the same time. That is, when the above width W2 is larger than the width W1, the operating band of the IFA antenna 10 covers the CE band of 868.42 MHz, and the FCC band of 908.42 MHz at the same time.

To further elaborate the IFA antenna 10 in greater details, the radiation field patterns of the IFA antenna 10 operating in different bands are disclosed below. Normally, when the antenna is measured when standing along, if the efficiency is over 70% and the gain is larger than 1 dB, then the antenna will function normally when disposed in the housing of an electronic device. The standing along condition refers to the condition when there are no electronic elements surrounding and causing interference to the antenna and the antenna is not disposed in the housing.

To further elaborate that the IFA antenna 10 disposed in the housing of the electronic device can function normally, the following FIG. 4A, FIG. 4B, FIG. 4C, FIG. 5A, FIG. 5B, FIG. 5C, FIG. 6A, FIG. 6B and FIG. 6C respectively show the radiation field patterns of the IFA antenna 10 operation under different bands.

Figure 4A:
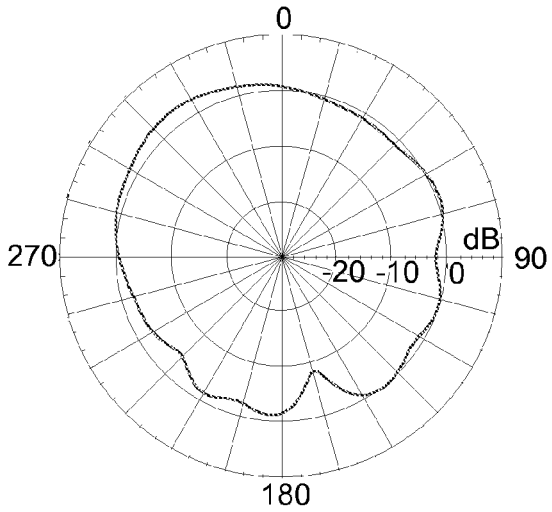
FIG. 4A shows an X-Z plane radiation field pattern of the IFA antenna 10 under 868 MHz.
Figure 4B:
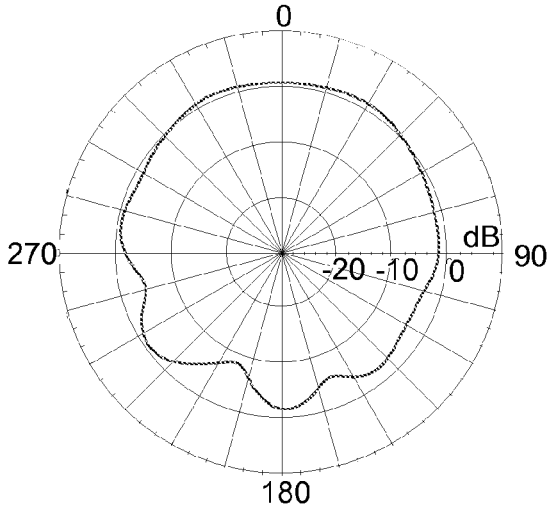
FIG. 4B shows a Y-Z plane radiation field pattern of the IFA antenna 10 under 868 MHz.
Figure 4C:
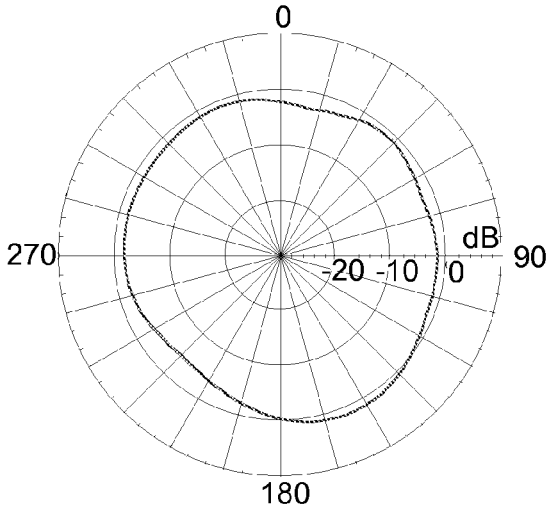
FIG. 4C shows an X-Y plane radiation field pattern of the IFA antenna 10 under 868 MHz.

Referring to at the same time FIGS. 4A, 4B and 4C. FIG. 4A shows an X-Z plane radiation field pattern of the IFA antenna 10 under 868 MHz. FIG. 4B shows a Y-Z plane radiation field pattern of the IFA antenna 10 under 868 MHz. FIG. 4C shows an X-Y plane radiation field pattern of the IFA antenna 10 under 868 MHz. When the operating frequency of the IFA antenna 10 is equal to 868 MHz, the antenna gain is equal to 1.934 dBi and the efficiency is equal to 95.075%. The X-Z plane radiation field pattern of the IFA antenna 10 under 868 MHz is illustrated in FIG. 4A. The Y-Z plane radiation field pattern of the IFA antenna 10 under 868 MHz is illustrated in FIG. 4B. The X-Y plane radiation field pattern of the IFA antenna 10 under 868 MHz is illustrated in FIG. 4C.

Figure 5A:
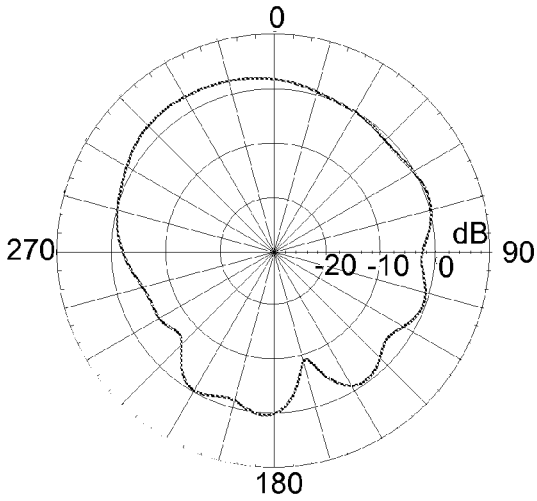
FIG. 5A shows an X-Z plane radiation field pattern of the IFA antenna 10 under 888 MHz.
Figure 5B:
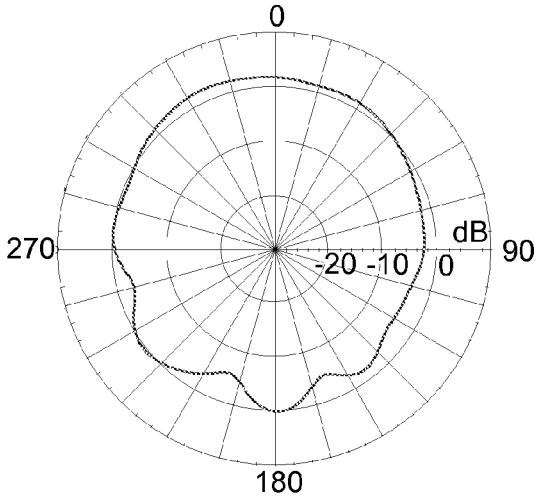
FIG. 5B shows a Y-Z plane radiation field pattern of the IFA antenna 10 under 888 MHz.
Figure 5C:
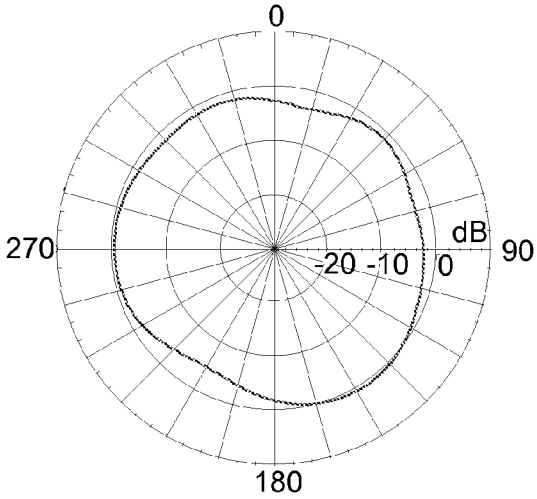
FIG. 5C shows an X-Y plane radiation field pattern of the IFA antenna 10 under 888 MHz.

Referring to FIGS. 5A, 5B and 5C at the same time. FIG. 5A shows an X-Z plane radiation field pattern of the IFA antenna 10 under 888 MHz. FIG. 5B shows a Y-Z plane radiation field pattern of the IFA antenna 10 under 888 MHz. FIG. 5C shows an X-Y plane radiation field pattern of the IFA antenna 10 under 888 MHz. When the operating frequency of the IFA antenna 10 is equal to 888 MHz, the antenna gain is equal to 2.674 dBi and the efficiency is equal to 87.745%. The X-Z plane radiation field pattern of the IFA antenna 10 under 888 MHz is illustrated in FIG. 5A. The Y-Z plane radiation field pattern of the IFA antenna 10 under 888 MHz is illustrated in FIG. 5B. The X-Y plane radiation field pattern of the IFA antenna 10 under 888 MHz is illustrated in FIG. 5C.

Figure 6A:
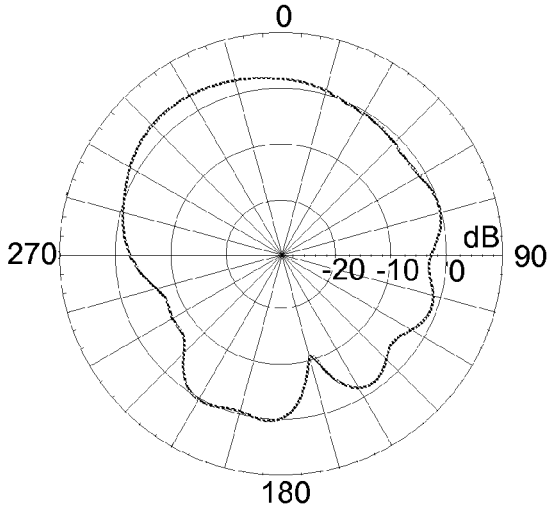
FIG. 6A shows an X-Z plane radiation field pattern of the IFA antenna 10 under 908 MHz.
Figure 6B:
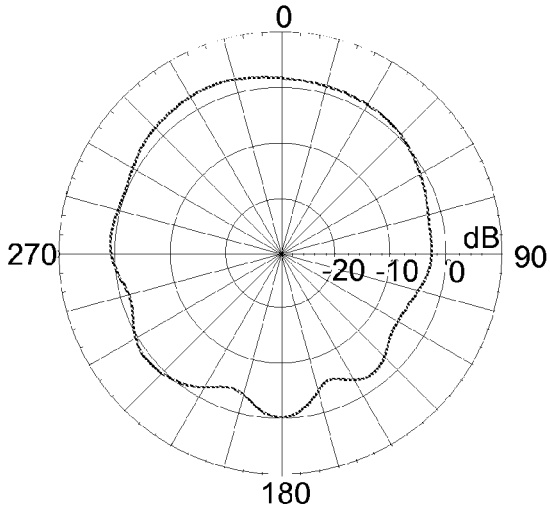
FIG. 6B shows a Y-Z plane radiation field pattern of the IFA antenna 10 under 908 MHz.
Figure 6C:
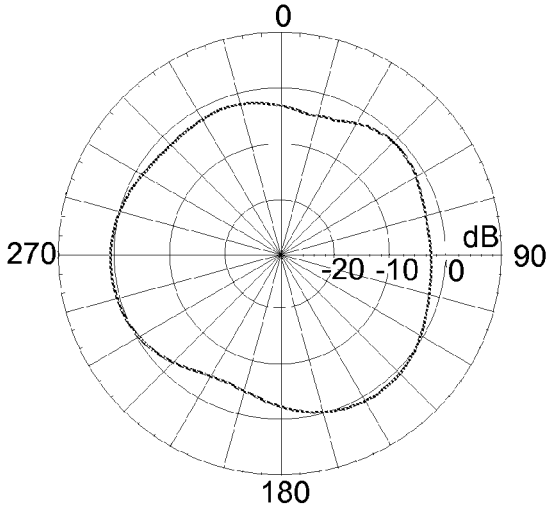
FIG. 6C shows an X-Y plane radiation field pattern of the IFA antenna 10 under 908 MHz.

Referring to FIGS. 6A, 6B and 6C at the same time. FIG. 6A shows an X-Z plane radiation field pattern of the IFA antenna 10 under 908 MHz. FIG. 6B shows a Y-Z plane radiation field pattern of the IFA antenna 10 under 908 MHz. FIG. 6C shows an X-Y plane radiation field pattern of the IFA antenna 10 under 908 MHz. When the operating frequency of the IFA antenna 10 is equal to 908 MHz, the antenna gain is equal to 3.248 dBi and the efficiency is equal to 85.403%. The X-Z plane radiation field pattern of the IFA antenna 10 under 908 MHz is illustrated in FIG. 6A. The Y-Z plane radiation field pattern of the IFA antenna 10 under 908 MHz is illustrated in FIG. 6B. The X-Y plane radiation field pattern of the IFA antenna 10 under 908 MHz is illustrated in FIG. 6C.

According to the above FIG. 4A, FIG. 4B, FIG. 4C, FIG. 5A, FIG. 5B, FIG. 5C, FIG. 6A, FIG. 6B and FIG. 6C, the efficiency of IFA antenna 10 is always larger than 70%, and the gain is also larger than 1dB no matter the IFA antenna 10 under 868 MHz, 888 MHz or 908 MHz. Besides, according to the above FIG. 4A, FIG. 4B, FIG. 4C, FIG. 5A, FIG. 5B, FIG. 5C, FIG. 6A, FIG. 6B and FIG. 6C, the radiation field pattern of the IFA antenna 10 is nearly round and there are no many indents on the edge. This implies that the IFA antenna 10 has less dead zones in communication and can effectively transmit the wireless signal to all corners in the space. Thus, when the IFA antenna 10 functions normally and has excellent quality in wireless communication even when the IFA antenna 10 is disposed in the housing of electronic device.

According to the IFA antenna disclosed in the above embodiment of the invention, the width of the radiation portion is larger than the width of the ground portion, such that the operating band of the IFA antenna is capable of covering multiple bands. Thus, there is no need to have more than one antenna in response to different bands of the CE and FCC protocols.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An inverse F antenna (IFA), comprising:

a rectangular ground element, the rectangular ground element having a first width and a first length, the first length being larger than the first width;

a rectangular radiation element, the rectangular radiation element having a second width and a second length, wherein the second length is larger than the second width, and the second width of the rectangular radiation element is larger than the first width of the rectangular ground element, such that the operating band of the IFA antenna covers at least a first band and a second band at the same time;

a short-circuit element disposed on the rectangular ground element and connected to the rectangular radiation element; and a feed-in element connected to the rectangular radiation element.

2. The IFA antenna according to claim 1, wherein the short-circuit element having a third width and a third length, the third length is larger than the third width, the third width of the short-circuit element is equal to the first width of the rectangular ground element.

3. The IFA antenna according to claim 1, wherein a ratio between the second width of the rectangular radiation element and the first width of the rectangular ground element is larger than 1.15.

4. The IFA antenna according to claim 1, wherein a ratio between the second width of the rectangular radiation element and the first width of the rectangular ground element is smaller than 2.

5. The IFA antenna according to claim 1, being conformed to Z-wave protocol.

6. The IFA antenna according to claim 1, wherein the first operating band is 868 MHz, and the second operating band is 908 MHz.

7. The IFA antenna according to claim 1, wherein the rectangular radiation element is a rectangular metallic piece.

8. The IFA antenna according to claim 1, wherein the rectangular ground element is a rectangular metallic piece.

9. The IFA antenna according to claim 1, wherein the short-circuit element is a rectangular metallic piece.

10. The IFA antenna according to claim 1, wherein one end of the short-circuit element is connected to one end of the rectangular radiation element, and the other end of the short-circuit element is connected to one end of the rectangular ground element.

* * * * *